US005372155A

United States Patent [19]

You

[11] Patent Number: 5,372,155

[45] Date of Patent: Dec. 13, 1994

[54] JOINT MECHANISM FOR AN UMBRELLA

[76] Inventor: Ching-Chuan You, P.O. Box 1-79, Taipei, Taiwan, Prov. of China

[21] Appl. No.: 145,814

[22] Filed: Nov. 2, 1993

[51] Int. Cl.[5] ..... A45B 25/00

[52] U.S. Cl. ..... 135/29; 135/32; 403/170; 403/178

[58] Field of Search ..... 135/25.3, 25.31, 25.34, 135/29–31, 32; 403/170, 174, 178, 217

[56] References Cited

U.S. PATENT DOCUMENTS

| | | | |
|---|---|---|---|
| 3,021,854 | 2/1962 | Uthemann | 135/32 |
| 4,368,749 | 1/1983 | Lindler et al. | 135/30 X |
| 4,676,262 | 6/1987 | Yang | 135/25.3 |
| 4,867,596 | 9/1989 | Ocuin | 403/170 |
| 4,890,095 | 1/1992 | Jones | 403/217 X |
| 5,121,764 | 6/1992 | Wu | 135/31 |
| 5,193,566 | 3/1993 | Chen | 135/29 X |

FOREIGN PATENT DOCUMENTS

| | | | |
|---|---|---|---|
| 434020 | 1/1912 | France | 135/25.31 |
| 553 | of 1879 | United Kingdom | 135/32 |

*Primary Examiner*—Lanna Mai

*Attorney, Agent, or Firm*—Lalos & Keegan

[57] ABSTRACT

An improved joint mechanism for an umbrella which has a first connecting device which includes a shaft member which has a channel through its length and is capable of sleeving onto a rib member and a saddle portion with a U-shaped configuration disposed at the middle portion of the shaft member. A second connecting device defines a connecting tube suitable for fixing a tip portion of a stretcher and a yoke portion having a supporting beam which can be rotatably received by the saddle portion of the first connecting device.

3 Claims, 4 Drawing Sheets

JOINT MECHANISM FOR AN UMBRELLA

BACKGROUND OF THE INVENTION

The present invention relates to a joint mechanism, more particularly, to a joint mechanism for an umbrella.

An umbrella generally includes stretchers that are connected to a runner which is slidably mounted on a metal rod at one end, and the other end is connected to a rib member via a joint. When the runner moves to its highest position, the stretchers are fully extended and the gore expands.

In the conventional art, the joint is made from metal and the rib members and the stretchers are made from fiber reinforced plastic (FRP) material. In assembly, the joint is firstly fixed to a suitable position, normally in the middle position, then the tip of the stretcher is riveted thereto. As shown in FIG. 4, two holes 222 in line are disposed at the lug of the joint 22 fixed at rib member 11. A cooperating hole is provided at the joint 21 of said stretcher 12. When the holes of joints 21 and 22 are aligned, a rivet 13 is inserted therein and then the other tip of said rivet is expanded to retain said rivet 13 from escaping. From the above description, it will be evident that the assembly is quite complicated and time-consuming as well as costly. Also, the machining of the rivet can only be smoothly done by a technician. Because there are at least eight rivets in a single umbrella, the defect rate cannot be lowered below a certain level. The increased cost and assembling time have a negative effect on the competitive ability of the manufacturer.

SUMMARY OF THE INVENTION

It is an object of this invention to provide an improved joint mechanism, by virtue of which, the rib member and the stretcher can be easily connected without difficulty.

In order to achieve the object set forth, the improved joint mechanism for an umbrella made according to this invention comprises a first connecting device defining a shaft member having a channel through its length which is capable of sleeving onto a rib member and a saddle portion having a U-shaped configuration disposed at the middle portion of said shaft member; and a second connecting device defining a connecting tube suitable for fixing a tip portion of a stretcher and a yoke portion having a supporting beam being rotatably received by the saddle portion of the connecting device.

In a preferable embodiment of this present invention, a plurality of holes is provided at the shaft member and tube member for receiving glue therein.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of an improved joint mechanism for an umbrella. In the drawings.

BRIEF DESCRIPTION OF A PREFERABLE EMBODIMENT

Figure 1:
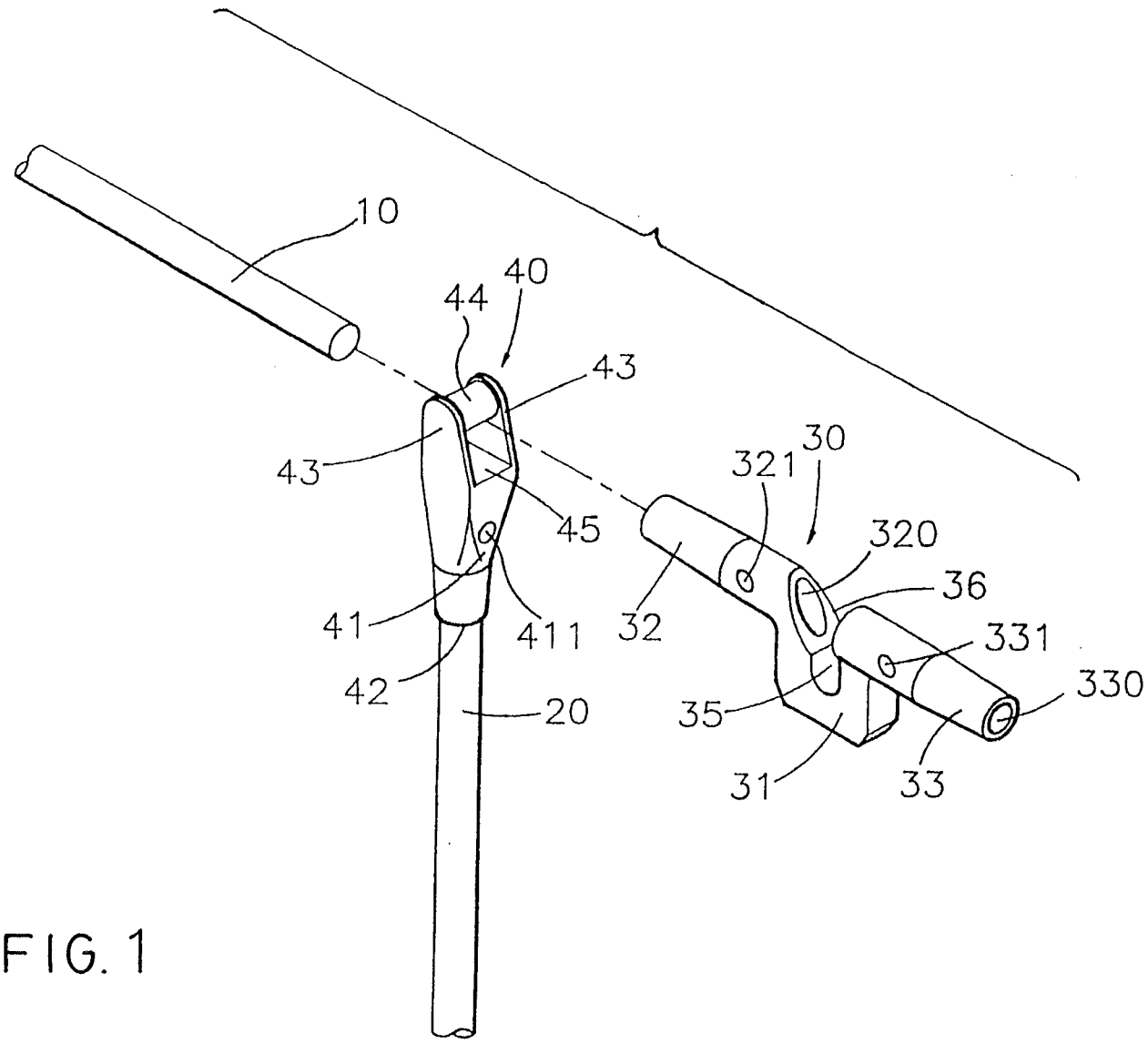
FIG. 1 is an exploded perspective view of the joint made according to this invention.
Figure 2:
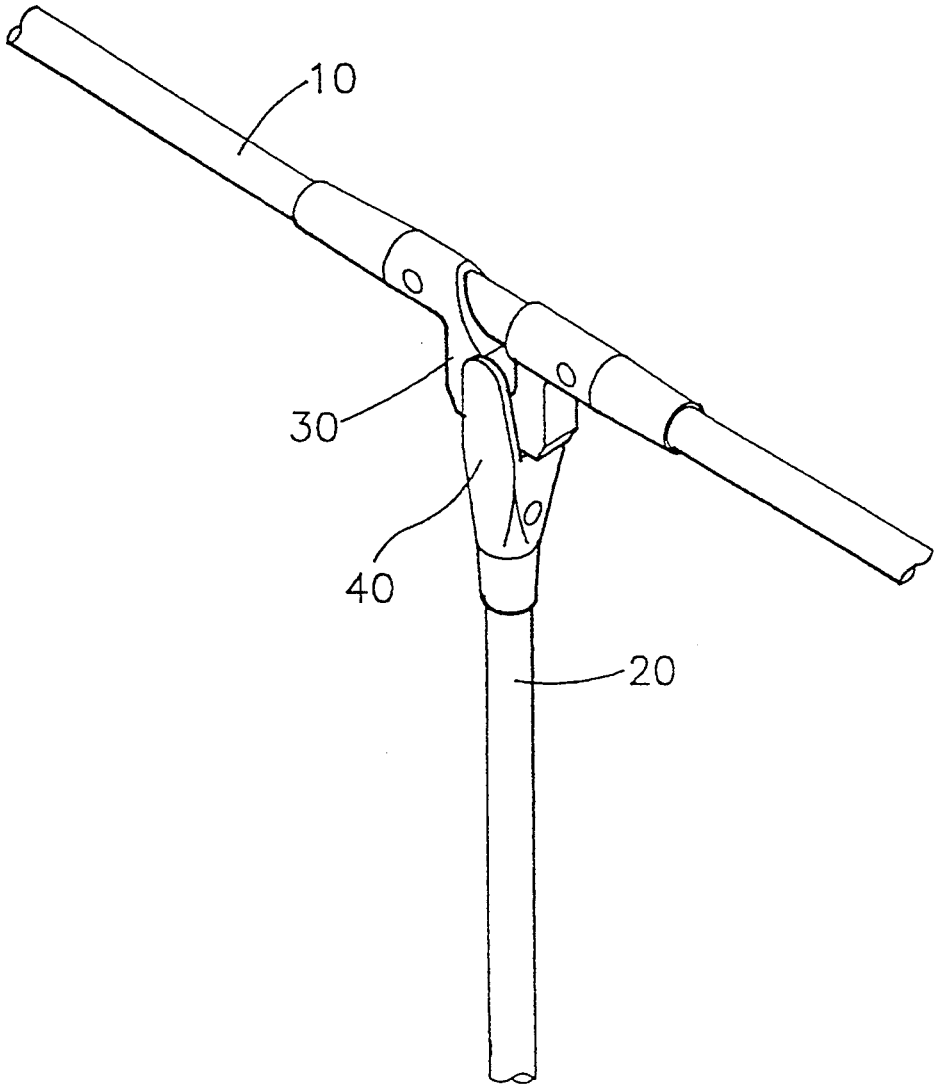
FIG. 2 is an assembled perspective view of the joint made according to this invention.
Figure 3:
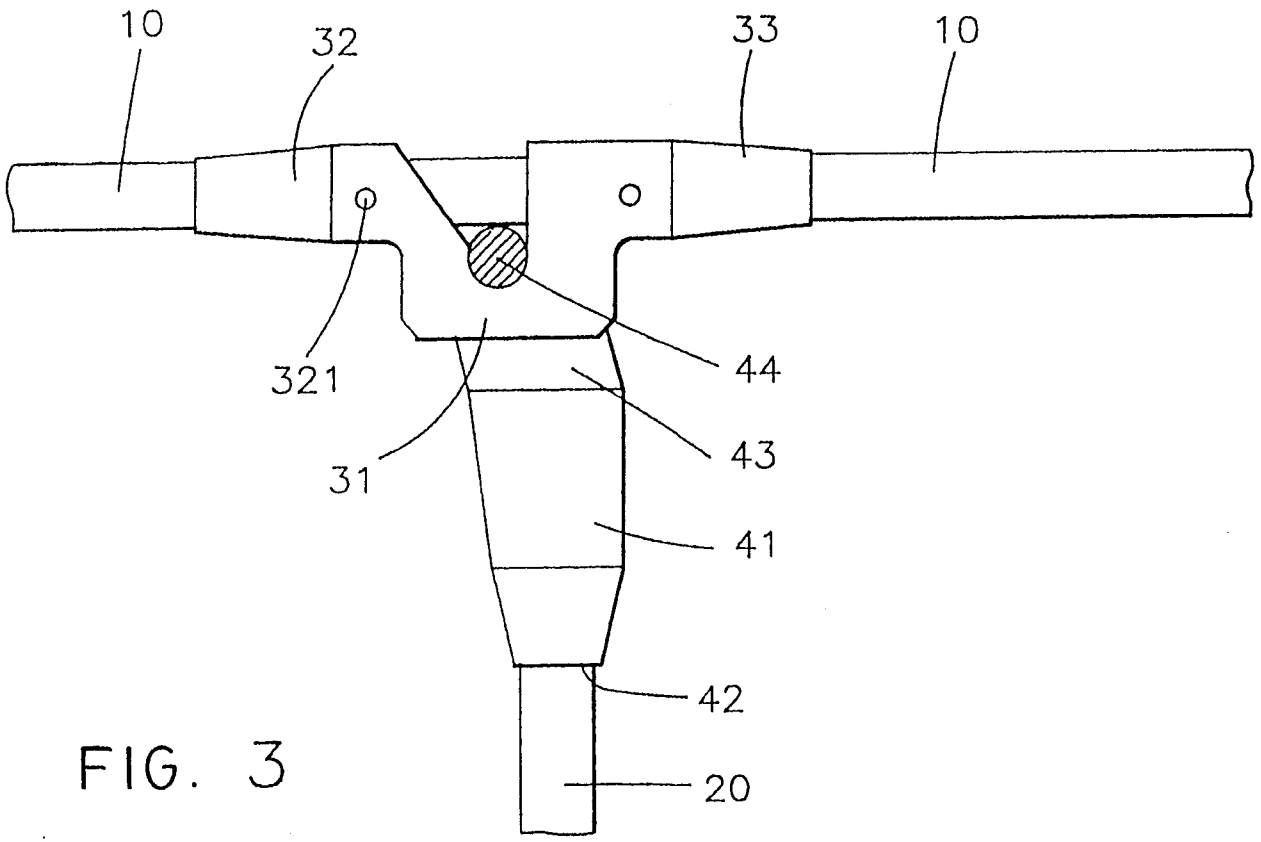
FIG. 3 is a cross sectional view of the joint made according to this invention.
Figure 4:
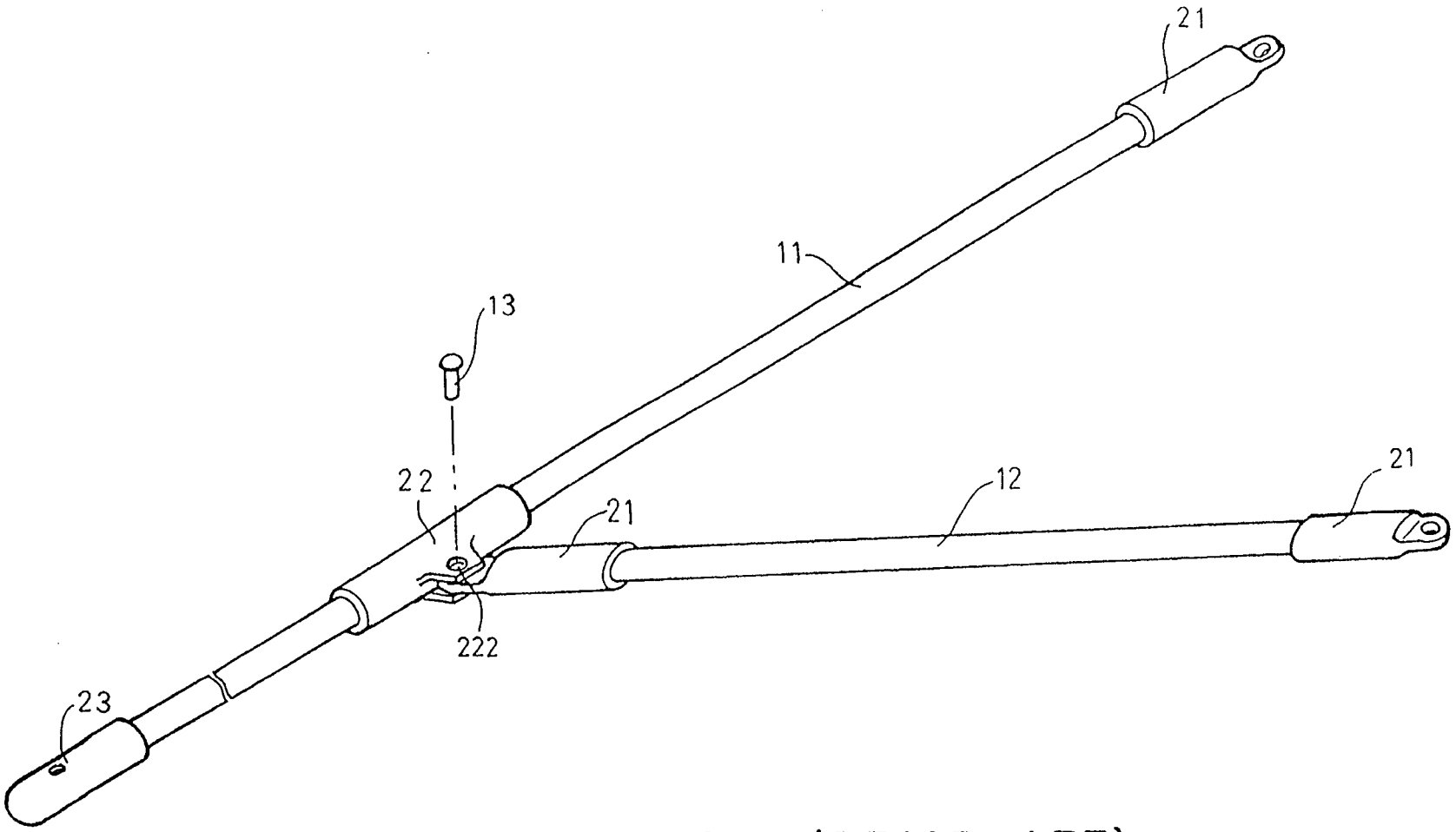
FIG. 4 (PRIOR ART)
FIG. 4 is a perspective view of a joint member of prior art.

Referring to FIGS. 1, 2, and 3, the joint mechanism for an umbrella made according to this invention comprises a first connecting device 30 including a first shaft member 32 and second shaft member 33 having respective channels 320, 330 through their length. The first connecting device 30 is capable of sleeving onto a rib member 10. The first connecting device 30 further includes a saddle portion 31 having a U-shaped configuration disposed between said shaft members 32, 33. The saddle 31 has a round bottom 35 therein. For easy assembly, a slope portion 36 is provided at shaft member 32. In a preferable embodiment, a plurality of holes 321, 331 is provided respectively at said shaft members 32, 33 for receiving glue therein.

A second connecting device 40 including a connecting tube 41 having a channel 42 thereof suitable for receiving and fixing a tip portion of a stretcher 20. A yoke portion 43 is disposed at the upper portion of tube 41. The yoke portion 43 has at its upper end a supporting beam 44 therebetween which can be rotatably received by said saddle 31 of said first connection member 30. A receiving space 45 is defined between said beam 44 and the bottom of said yoke portion 43. A hole 411 is provided at tube 41 for receiving glue therein.

In assembly, first connecting device 30 is first inserted into yoke portion 43. By provision of slope portion 36, saddle portion 31 slides easily into receiving space 45 so that beam 44 rests on round bottom 35 of said saddle 31. When saddle portion 31 and beam 44 are smoothly meshed, rib member 10 is inserted into first and second shaft members 32, 33 through said channels 320, 330. By such arrangement, the beam 44 is retained within said saddle 31 by rib 10. Then, glue or adhesive will be added into holes 321, 331 and 411 for fixing those members.

By virtue of this invention, the joint for the rib and stretcher can be easily connected without any complicated procedure.

Although the present invention has been described in connection with preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. An improved joint mechanism connecting together a stretcher and rib member of an umbrella comprising:

a first connecting device;

a second connecting device having a support member;

a first connecting device including a U-shaped saddle member including first and second shaft members each including a channel through the length of each said shaft member for receiving said rib member, and a bottom portion between said first and second shaft members to form an opening for receiving a support member of a second connecting device;

a second connecting device including a connecting tube and a yoke member formed on said connecting tube, said connecting tube including a channel for receiving a tip portion of a stretcher, said yoke member including a lower end and a support beam at the yoke member upper end to form a space between a yoke member lower end and said support beam, said space for receiving said first connecting device, wherein said joint mechanism connects said stretcher and rib member by inserting said first connecting device into said space of said yoke member with said support beam being received in said opening of said saddle member, and then inserting said rib member through said channels of said first and second shaft members to closed said opening and retain said support beam in said saddle member.

2. An improved joint mechanism as in claim 1 wherein said support beam has a round cross section.

3. An improved joint mechanism as in claim 1 wherein said saddle member includes a sloped portion at said first shaft member.

* * * * *

UNITED STATES PATENT AND TRADEMARK OFFICE

CERTIFICATE OF CORRECTION

PATENT NO. : 5,372,155

DATED : December 13, 1994

INVENTOR(S) : Ching-Chuan You

It is certified that error appears in the above-identified patent and that said Letters Patent is hereby corrected as shown below:

In Claim 1, col. 4, line 3, delete "closed" and insert -- close --.

Signed and Sealed this

Seventh Day of March, 1995

*Attest:*

*Attesting Officer*

BRUCE LEHMAN

*Commissioner of Patents and Trademarks*